US007717702B2

(12) United States Patent
Aycock et al.

(10) Patent No.: US 7,717,702 B2
(45) Date of Patent: May 18, 2010

(54) DIRECT SIDEWALL VENT SYSTEM

(75) Inventors: James Lawrence Aycock, Kinston, NC (US); Steven E. Guzorek, Kinston, NC (US)

(73) Assignee: Field Controls, LLC, Kinston, NC (US)

( * ) Notice: Subject to any disclaimer, the term of this patent is extended or adjusted under 35 U.S.C. 154(b) by 362 days.

(21) Appl. No.: 11/176,913

(22) Filed: Jul. 7, 2005

(65) Prior Publication Data

US 2007/0009842 A1 Jan. 11, 2007

(51) Int. Cl.
*F23M 3/04* (2006.01)

(52) U.S. Cl. ..... 431/10; 431/20; 431/89; 126/312; 126/317; 126/116 A; 454/359; 454/36; 110/163; 110/184

(58) Field of Classification Search ..... 431/10, 431/20, 89; 126/85 B, 307 A, 285, 312, 116, 126/80, 293, 317, 315, 314, 316; 110/163, 110/162, 147, 184, 160; 454/35, 36, 359, 454/363, 44, 347; 138/115, 114, 116, 38, 138/40

See application file for complete search history.

(56) References Cited

U.S. PATENT DOCUMENTS

| | | | | |
|---|---|---|---|---|
| 2,711,683 A | | 6/1955 | Ryder | |
| 3,552,377 A | * | 1/1971 | Hodges | 126/85 B |
| 3,994,280 A | | 11/1976 | Winters | |
| 4,424,792 A | * | 1/1984 | Shimek et al. | 126/80 |
| 4,757,802 A | | 7/1988 | Guzorek | |
| 4,765,308 A | * | 8/1988 | Marran | 126/85 B |
| 5,012,793 A | | 5/1991 | Guzorek | |
| 5,062,354 A | | 11/1991 | Goins | |
| 5,261,389 A | * | 11/1993 | Trieb | 126/85 B |
| 6,044,835 A | | 4/2000 | Brown et al. | |
| 6,102,030 A | | 8/2000 | Brown et al. | |
| 6,550,687 B2 | | 4/2003 | Lyons et al. | |
| 6,776,704 B2 | | 8/2004 | Goncalves et al. | |
| 2003/0098358 A1 | | 5/2003 | Lyons et al. | |

* cited by examiner

*Primary Examiner*—Steven B McAllister
*Assistant Examiner*—Avinash Savani
(74) *Attorney, Agent, or Firm*—Wood, Phillips, Katz, Clark & Mortimer

(57) ABSTRACT

A direct sidewall vent system between a fuel-burning appliance in a first space and an external atmosphere, through a wall between the first space and external atmosphere. The direct sidewall vent system has a wall assembly that defines a first passage for communicating combustion gas generated through operation of the fuel-burning appliance to a first outlet through which the combustion gas is communicated to the external atmosphere. The wall assembly further defines a second passage for communicating makeup air from the external atmosphere to the fuel-burning appliance in the first space. The direct sidewall vent system further has an external portion that is situated within the external atmosphere and at which the first outlet is located. The external portion of the direct sidewall vent system has a top, a bottom, and spaced sides. The external portion of the direct sidewall vent system has a first inlet within the external atmosphere through which makeup air from the external atmosphere is communicated to the second passage. The first inlet is situated to draw makeup air from the external atmosphere primarily from a location above the first outlet.

21 Claims, 4 Drawing Sheets

DIRECT SIDEWALL VENT SYSTEM

BACKGROUND OF THE INVENTION

1. Field of the Invention

This invention relates to vent systems for fuel-burning appliances and, more particularly, to a direct vent system that communicates between an internal space, within which the appliance is located, and the external atmosphere, through a vertically extending sidewall.

2. Background Art

Fuel-burning appliances are commonly equipped with direct sidewall vent systems. Typically, concentric conduits communicate between the appliance and an external atmosphere generally in a horizontal direction through an outside, vertically extending sidewall. An inner conduit communicates combustion gases from the appliance to the external atmosphere. An annular passage between the inner conduit and a surrounding conduit communicates makeup air from the external atmosphere to the appliance.

Ideally, to optimize operation and efficiency of the fuel-burning appliance, air flow volume to, and pressure in, the appliance burner are maintained within specific ranges. Reduced air flow to the burner may cause sooting, which is detrimental to the appliance and also produces pollutants that are undesirably discharged to the atmosphere and potentially to against the interior and exterior of the building within which the appliance is located.

The type and location of the intake for makeup air and its relationship to the subjacent surface, combustion gas outlet, and wall upon which the vent system is mounted, are critical in the design of such systems to maintain adequate air flow. Myriad different makeup air intakes have been devised in the industry. It is known, for example, to provide a makeup air intake at one side, or opposite sides, of the conduits. Operation of certain of these systems may be adversely affected by atmospheric wind conditions.

Environmental winds may adversely affect other vent designs as well. High winds tend to block the discharge of combustion gas. A pressure buildup may result in the combustion chamber that slows down air flow to the burner. This may result in sooting, with the attendant disadvantages, noted above.

More commonly, the makeup air is drawn from a region at the bottom of the external portion of the vent system. These bottom located intakes have some of their own inherent disadvantages.

Commonly, those installing direct vent systems will locate the external portion of the vent system in close proximity to the ground, either at the behest of the building owner, for purposes of aesthetics, or for reasons dictated by the building geometry or convenience and ease of installation. Manufacturers of these vent systems typically will specify a minimum clearance between the external portion of the vent system and the subjacent ground. Even within these specifications, there are some inherent problems that are commonly encountered.

First of all, an accumulation of snow or debris may effectively reduce the clearance between the makeup air intake and the ground. The intake may be partially, or in a worse case altogether, blocked so that the required air flow does not occur at the combustion chamber.

Even if the clearance is within manufacturers' specifications, there is also the possibility that atmospheric winds may interact with the ground and surrounding structures to produce undesired pressure buildup at the makeup air intake.

Further, the discharged gases, and potentially pollutants, entrained therein, may be redirected at the subjacent surface so as to be recirculated by being drawn back into the makeup air intake. At low mounting heights, the makeup air intake is also prone to picking up debris that may be elevated thereto by winds and/or the discharging combustion gases. This debris may be detrimentally recirculated to the appliance.

Heretofore, in the interest of facilitating installation, or addressing aesthetic concerns, building owners have mounted the external vent components in close proximity to the ground, which has caused them to have to contend with the above-mentioned problems associated with conventional vent systems; notably variations in efficiency of the appliance operation, temporary flame-outs, sooting, etc. The industry continues to seek out designs to address some or all of the above problems.

SUMMARY OF THE INVENTION

In one form, the invention is directed to a direct sidewall vent system between a fuel-burning appliance in a first space and an external atmosphere, through a wall between the first space and external atmosphere. The direct sidewall vent system has a wall assembly that defines a first passage for communicating combustion gas generated through operation of the fuel-burning appliance to a first outlet through which the combustion gas is communicated to the external atmosphere. The wall assembly further defines a second passage for communicating makeup air from the external atmosphere to the fuel-burning appliance in the first space. The direct sidewall vent system further has an external portion that is situated within the external atmosphere and at which the first outlet is located. The external portion of the direct sidewall vent system has a top, a bottom, and spaced sides. The external portion of the direct sidewall vent system has a first inlet within the external atmosphere through which makeup air from the external atmosphere is communicated to the second passage. The first inlet is situated to draw makeup air from the external atmosphere primarily from a location above the first outlet.

In one form, the wall assembly has a vent pipe that has a central axis and defines at least a part of the first passage. The first inlet is situated to draw makeup air from the external atmosphere primarily from a location above the central axis of the vent pipe.

In one form, the second passage has a central axis and the first inlet is situated to draw makeup air from the external atmosphere from a location above the central axis of the second passage.

In one form, the wall assembly has substantially concentric cylindrical walls between which at least a part of the second passage is defined.

The first inlet may be situated substantially fully above the central axis of the vent pipe and/or central axis of the second passage.

In one form, the wall assembly has a funnel-shaped portion that has a progressively decreasing cross-sectional area from an upstream end of the first passage towards a) a downstream end of the first passage and b) the first outlet through which combustion gas is jetted to the external atmosphere.

The funnel-shaped portion may be oriented to jet combustion gas in a direction angularly downwardly and away from the wall between the first space and external atmosphere.

In one form, the wall assembly comprises a shroud that defines the first inlet.

The first inlet may open downwardly.

In one form, the shroud has a funnel-shaped portion in which incoming makeup air is expanded.

In one form, the wall assembly defines a surface below the first inlet that is inclined upwardly towards the first inlet so as to deflect air directed at the wall between the first space and the external atmosphere towards the first inlet.

The first outlet may open downwardly.

A flow inducing mechanism may be provided for at least one of a) inducing flow of combustion gas through the first passage and b) inducing flow of makeup air through the second passage.

The direct sidewall vent system may be provided in combination with a fuel-burning appliance within a first space bounded by a wall through which the direct sidewall vent system extends.

The wall assembly may be made from stainless steel.

In one form, the wall assembly has a second pipe surrounding the vent pipe and between which at least a part of the second passageway is defined. The second pipe has a top and bottom and makeup air through the first inlet is introduced to the second passage primarily through the bottom of the second pipe.

The invention is further directed to a direct sidewall vent system between a fuel-burning appliance in a first space and an external atmosphere through a wall between the first space and external atmosphere. The direct sidewall vent system has a wall assembly that defines a first passage for communicating combustion gas generated through operation of the fuel-burning appliance to a first outlet through which the combustion gas is communicated to the external atmosphere. The wall assembly defines a second passage for communicating makeup air from the external atmosphere to the fuel-burning appliance in the first space. The direct sidewall vent system has an external portion that is situated within the external atmosphere and at which the first outlet is located. The external portion of the direct sidewall vent system has a top, a bottom, and spaced sides. The external portion of the direct sidewall vent system has a first inlet within the external atmosphere through which makeup air from the external atmosphere is communicated to the second passage. The first inlet is situated to draw makeup air from the external atmosphere primarily from a location at the top of the external portion of the direct sidewall vent system.

The invention is further directed to a method of venting a fuel-burning appliance in a first space through a vertical sidewall between the first space and an external atmosphere. The method includes the steps of: providing a vent system having a wall assembly that defines first and second passages with one of the first and second passages having a central axis that extends through the vertical sidewall; operating the fuel-burning appliance and thereby producing combustion gas; causing the combustion gas to be directed through the first passage and discharge through a first outlet to the external atmosphere; and causing makeup air to be directed from the external atmosphere through an inlet that is in communication with the second passage and from the inlet primarily downwardly towards the cental axis of the one of the first and second passages for delivery through the second passage to the fuel-burning appliance.

The invention is further directed to a method of venting a fuel-burning appliance in a first space through a vertical sidewall between the first space and an external atmosphere. The method includes the steps of: providing a vent system having a wall assembly that defines first and second passages with one of the first and second passages having a central axis that extends through the vertical sidewall; providing a vent system having a wall assembly that defines first and second passages, with one of the first and second passages having a central axis that extends through the vertical sidewall, and that has an external portion exposed to the external atmosphere and having a top, bottom, and spaced sides; causing the combustion gas to be directed through the first passage and discharge through a first outlet to the external atmosphere; and causing makeup air to be directed from the external atmosphere through an inlet primarily at the top of the external portion of the vent system for communication through the second passage to the fuel-burning appliance.

DETAILED DESCRIPTION OF THE DRAWINGS

Figure 1:
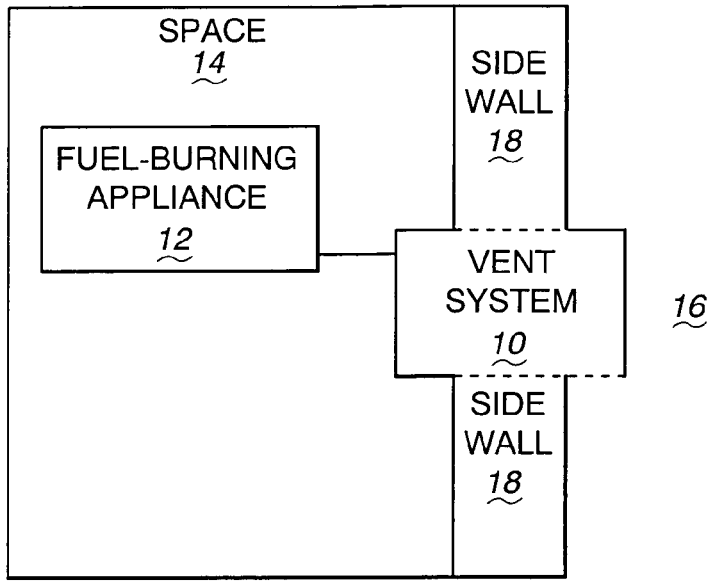
FIG. 1 is a schematic representation of a direct sidewall vent system, according to the present invention, operatively assembled through a vertically extending sidewall to communicate between a fuel-burning appliance and the external atmosphere through the sidewall.
Figure 2:
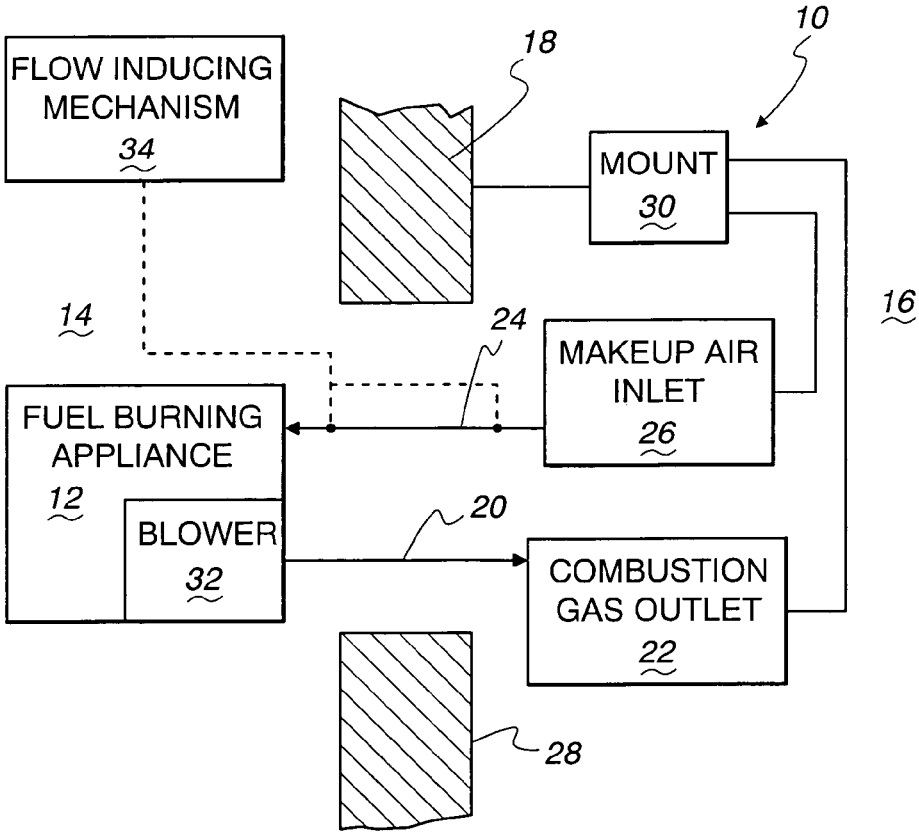
FIG. 2 is a view as in FIG. 1 wherein further detail of the vent system is shown in schematic form.

In FIGS. 1 and 2, a direct, sidewall vent system, according to the present invention, is shown schematically at 10 in association with a fuel-burning appliance 12. The fuel-burning appliance 12 is not limited in nature and is shown schematically to encompass any appliance that operates through combustion of a fuel and requires discharge of combustion gases. The fuel-burning appliance 12 is provided within a space 14, typically a room of a building, separated from the external atmosphere 16 by a vertically extending sidewall 18.

The vent system 10 has a wall assembly, described in detail below, that defines a first passage 20 for communicating combustion gas generated through operation of the fuel-burning appliance 12 to an external combustion gas outlet 22, through which the combustion gas is communicated to the external atmosphere 16. The wall assembly further defines a second passage 24 for communicating makeup air from the external atmosphere 16 to the fuel-burning appliance 12 in the space 14. An external portion of the vent system 10 has a makeup air inlet 26 within the external atmosphere 16 through which makeup air from the external atmosphere 16 is communicated to the second passage 24. The external portion of the vent system 10 additionally defines the combustion gas outlet 22 and is secured at an external surface 28 of the sidewall 18 through an appropriate mount 30.

The fuel-burning appliance 12 may have a blower 32 that directs combustion gas from the fuel-burning appliance 12 through the first passage 20 to and through the combustion gas outlet 22 to the external atmosphere 16. Makeup air from the external atmosphere 16 is drawn in through the makeup air inlet 26 and conveys to and through the second passage 24 to the fuel-burning appliance 12. An optional flow inducing mechanism 34 may be provided at an internal or external location to pressurize makeup air moving in the second passage 24 back to the fuel-burning appliance 12. However, the present invention makes possible an adequate flow of makeup air to the fuel-burning appliance 12 without such a mechanical assist requirement.

The vent system 10 is shown schematically at 10 in FIGS. 1 and 2 to encompass virtually unlimited different configurations of wall structure. Regardless of the configuration, the invention contemplates that the makeup air inlet 26 draws makeup air from the external atmosphere 16 primarily from an upper location on the external portion of the vent system 10, preferably above the combustion gas outlet 22. Details of one exemplary configuration for the vent system 10 will now be described with respect to FIGS. 3-5, with it being understood that this particular configuration is exemplary in nature only.

The aforementioned wall assembly is shown on the vent system 10 at 36. The wall assembly 36 consists of a vent pipe 38, with a central axis 40, that defines a part of the first passage 20 between the blower 32 on the fuel-burning appliance 12 and the combustion gas outlet 22 on the external portion 42 of the vent system 10. A downstream end 44 of the vent pipe 38 is suitably secured within an opening 46 defined in a flat plate 48.

A wall 50 is cantilevered outwardly from the plate 48 and defines a flat surface 52 that slopes downwardly from the bottom of the opening 46. A shroud 54 has a wall 56 with an open bottom 58 and an open end 60. With the end 60 placed against the flat plate 48, the opening 46 and wall 50 reside within a chamber 62 bounded cooperatively by the wall 56 and flat plate 48.

Figure 4:
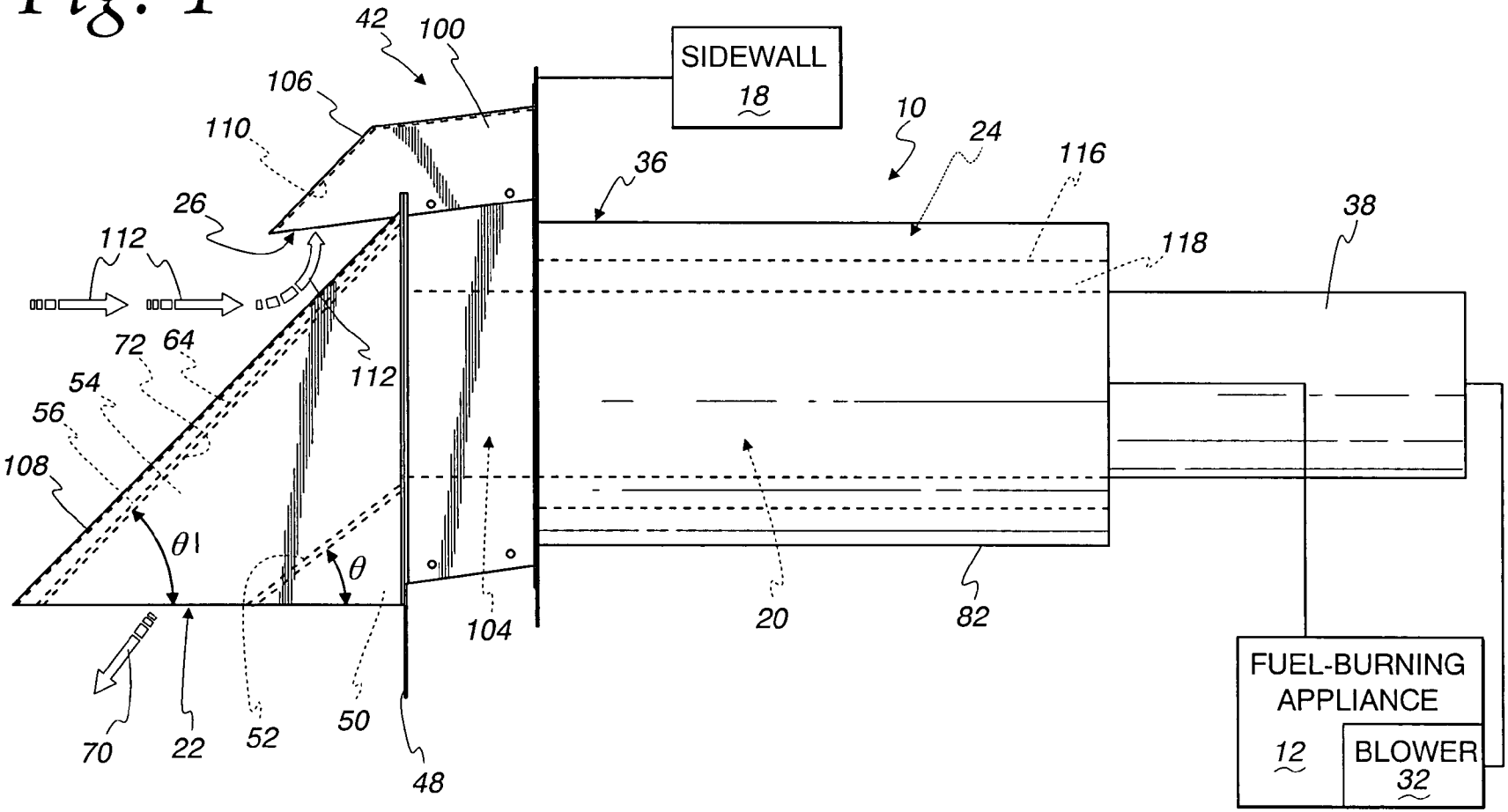
FIG. 4 is a side elevation of the vent system in FIG. 3.

With the shroud 54 secured to the flat plate 48, a sloping portion 64 of the shroud wall 56, spaced side portions 66, 68 on the shroud wall 56, and the wall 50 projecting from the flat plate 58, cooperatively define a funnel-shape portion of the wall assembly 36 that causes discharging combustion gas to be jetted generally in the direction of the arrow 70 in FIG. 4 to the external atmosphere 16, downwardly and away from the sidewall 18 upon which the vent system 10 is mounted. As seen in FIG. 4, the sloping portion 64 of the shroud wall 56 has an inside surface 72 that faces the surface 52 on the wall 50 and bounds a portion of the first passage 20 within the funnel-shaped portion of the wall assembly 36. The surface 52 is at an angle θ to horizontal, with the surface 72 at an angle θ1 to horizontal, with θ1 being greater than θ. The angles θ, θ1 may be on the order of 45°, but could vary considerably from 45°. Accordingly, the cross-sectional area of the portion of the first passage 20 within the shroud 54 progressively decreases towards the downstream end of the first passage 20 and the outlet 22. Through this arrangement, the aforementioned jetting action is produced that propels the combustion gases away from the sidewall 18 to prevent exposure of the gases to the sidewall 18 as might leave unsightly residue thereon. This jetting action also reduces the tendency of the combustion gases to recirculate into the second passage 24 through the makeup air inlet 26, as described in greater detail hereinbelow. The flat plate 48 projects to below the outlet 22 to deflect discharging combustion gases and shield the wall 18 from exposure thereto.

A hood 74, having the same general configuration as the shroud 54, but larger in dimension, is mounted against the flat plate 48 so that the shroud 54 resides substantially fully within a chamber 76 bounded by the hood 74. In addition to other functions, described below, the hood 74 shields the user from the surfaces on the shroud 54 that become heated in use.

The shroud 54 and hood 74 are provided with peripheral flanges 78, 80, respectively, which are suitably secured to the flat plate 48, as by separate fasteners, welding, or the like.

A second pipe 82, with a diameter larger than the diameter of the vent pipe 38, surrounds the vent pipe 38 to be in concentric relationship therewith so that an annular space 84 is defined between the pipes 38, 82. The annular space 84 defines part of the second passage 24 for communicating makeup air from the external atmosphere 16, drawn in at the inlet 26, to the fuel-burning appliance 12. A flanged, upstream end 86 of the second pipe 82 is secured suitably to a side 88 of the flat plate 48 facing oppositely to the direction faced by the surface 89 to which the shroud 54 and hood 74 are mounted.

A spacing frame at 90 is mounted to a flat plate 92 having the same, generally squared shape as shown for the flat plate 48. The flat plate 92 defines part of the mount 30, through which the vent system is secured to the sidewall 18. The spacing frame 90 consists of contiguous bottom and spaced side frame parts 94 and 96, 98, respectively. The frame parts 94, 96, 98 have the same width dimension W and are flanged to facilitate their attachment to the flat plates 48, 92, by any suitable means, so that the frame parts 94, 96, 98 maintain the flat plates 48, 92 together and spaced apart a distance equal to the width W.

A shroud 100 is attached through at least one flange 102 to the flat plate 92 and resides between the frame parts 96, 98. The shroud 100 and frame parts 94, 96, 98 cooperatively extend continuously around a chamber 104 between the flat plates 48, 92. The shroud 100 extends further from the flat plate 92 than the frame parts 94, 96, 98, with the additional extension having an inclined wall portion 106 that vertically overlies on inclined outer surface 108 of the hood 74 in vertically spaced relationship thereto. The inside surface 110 of the wall portion 106 of the shroud 100, and facing hood surface 108, may be substantially parallel or may converge in a downstream direction over a portion of the second passage 24 defined by these surfaces. The surface 108 axially coincides with the central axis of the vent pine 38 and, as depicted, blocks flow of air in an axial direction directly into the first passage 20. With the shroud 100 projecting, as seen most clearly in FIG. 4, the shroud 100 acts as an air scoop for funnelling atmospheric air through the inlet 26 into the passage 24. The angles of the surfaces 108, 110 may be on the order of 45°. However, these angles might vary considerably from 45°.

In windy conditions, air moving in the direction of the arrows 112 encounters the hood surface 108 and is progressively bent upwardly to move into the inlet 26 and is thereafter funneled into the chamber 104 wherein it expands. The air in the chamber 104 communicates radially through a series of openings 112 through the second pipe 82 and into the annular space 84 for delivery back to the fuel-burning appliance 12. The openings 112 are shown as circular with an exemplary diameter on the order of one inch. The openings 112 could have different sizes, shapes, and locations around the periphery of the pipe 82. One or more larger holes could be utilized in place of the openings 112 shown.

Figure 3:
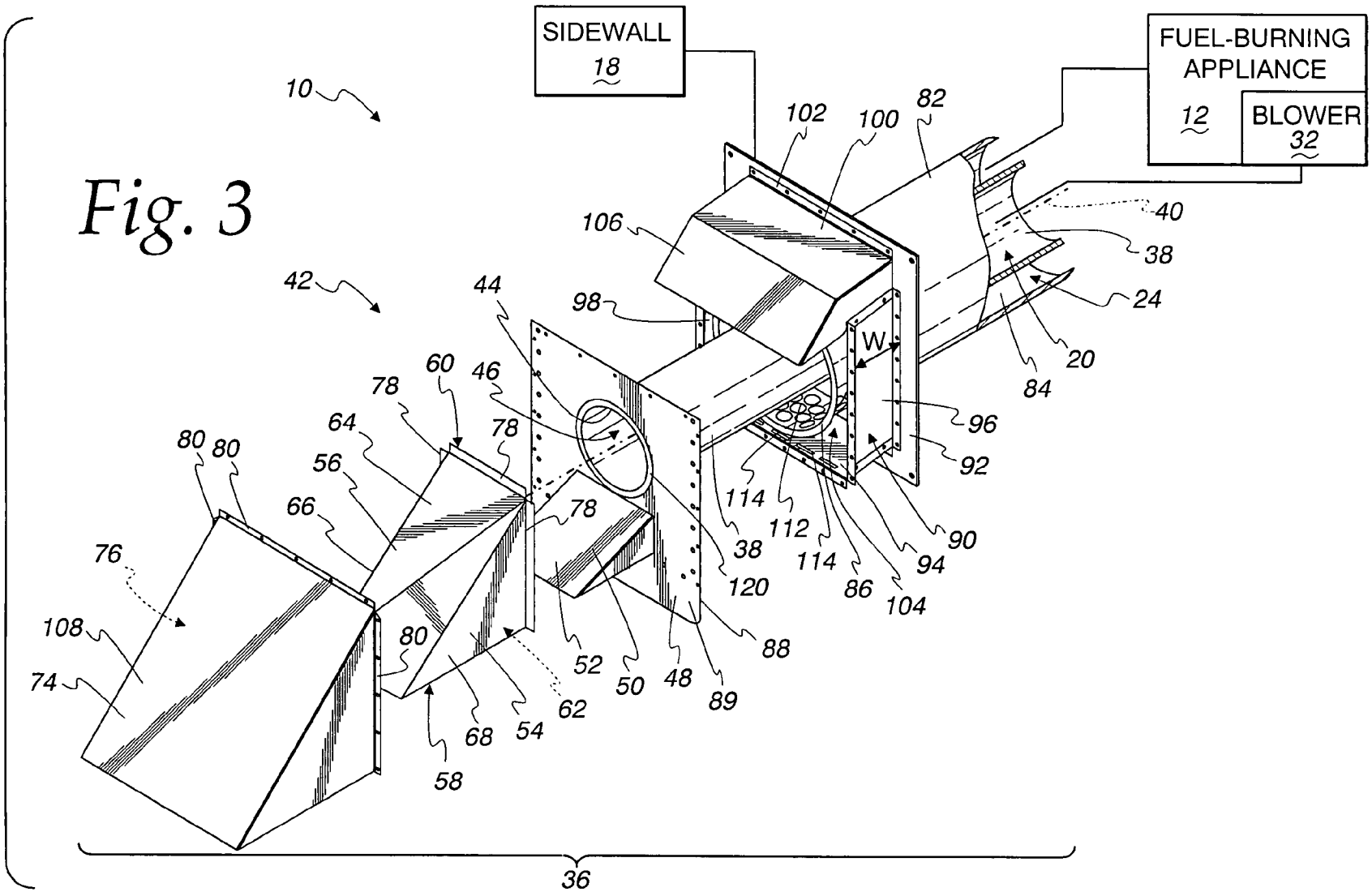
FIG. 3 is an exploded, perspective view of one specific exemplary form of the vent system in FIGS. 1 and 2.
Figure 5:
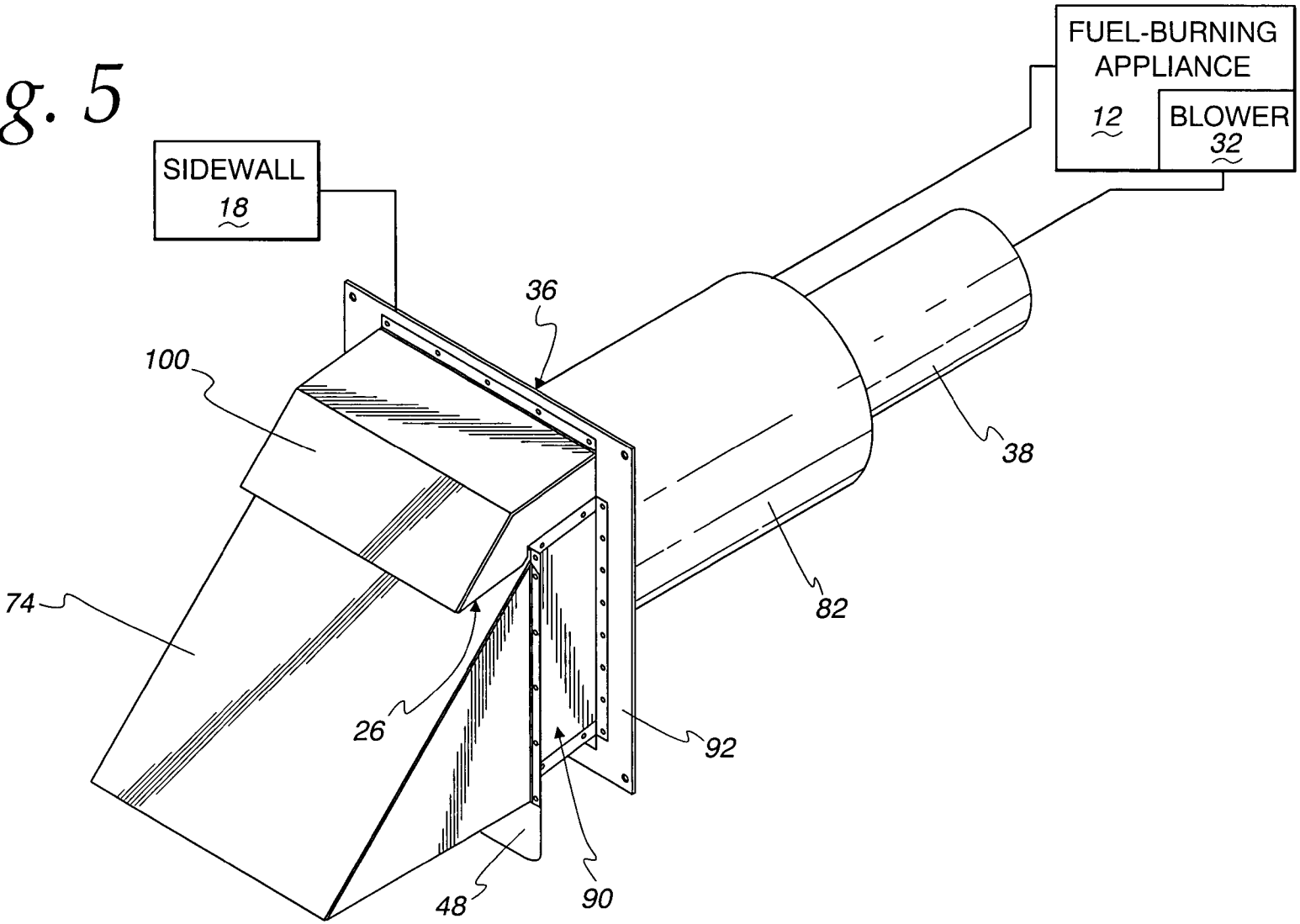
FIG. 5 is a perspective view of the vent system in FIGS. 3 and 4.

With this arrangement, substantially the entirety of the makeup air delivered to the fuel-burning appliance 12 through the second passage 24 is drawn from the external atmosphere 16 through the makeup air inlet 26 in the region at the top of the external portion 42 of the vent system 10 above the combustion gas outlet 22. The locations of the inlet 26 and outlet 22 are not limited to precisely what is shown in FIGS. 3-5. Preferably, the makeup air is drawn from the external atmosphere from a location located above the central axis 40 for one of the passages 20, 24. In this case, the central axes for the passages 20, 24 are coincident.

As seen in FIGS. 3-5, the makeup air inlet 26 is situated fully above the central axis 40. It is preferred that if not located entirely above the central axis, the makeup air inlet 26 be located so that substantially the entirety of the makeup air delivered to the fuel-burning appliance through the second passage 24 is drawn from the external atmosphere 16 primarily from a location above the central axis 40. As shown, and most preferably, the makeup air is drawn primarily from a location at the top of the external portion 42 of the vent system 10.

In operation, as the fuel-burning appliance 12 is operated, combustion gas is produced. Through the blower 32, and/or by reason of a temperature differential, the combustion gas is caused to be directed through the first passage 20, and more particularly initially through the vent pipe 38, through the shroud 54 and to and through the outlet 22.

The makeup air enters the downwardly opening inlet 26 and expands into the chamber 104 from where it communicates through the openings 112 into and through the annular space 84 to the fuel-burning appliance 12.

By reason of the top location of the makeup air inlet 26, and the jetting of the combustion gas from the outlet 22, there is potentially little recirculation of the combustion gas as makeup air. The bottom frame part 94 has a series of slots/openings 114 therethrough which allow drainage of any accumulated condensation and also provide an escape route for other foreign matter that may have migrated into the chamber 104. With the pipe openings 112 located at the bottom region of the pipe 82, any foreign matter that enters the chamber 104, as via the shroud, may drop against the periphery of the pipe 82. By reason of there not being openings in the top region of the pipe 82, this matter tends to slide guidingly down the pipe to against the bottom frame part 94 from where it may discharge through the slits/openings 114. Of course, the invention contemplates that openings through the pipe 82 may be provided at any peripheral location thereon. However, such a design would generally be more prone to causing entrainment of foreign matter into the makeup air supply communicated to the fuel-burning appliance 12.

In calm environmental conditions, system designs are normally such that the makeup air is drawn into the fuel-burning appliance 12 in adequate volume. Under windy conditions, the wind load tends to produce a pressure block at the outlet 22. As a result, a burner on the fuel-burning appliance 12 may be unable to achieve complete combustion whereupon sooting may occur. Under these windy conditions, the inventive design causes the impinging air to be funneled under pressure into the inlet 26 and through the second passage 24 to the fuel-burning appliance 12. With the pressurized makeup air, cleaner combustion in the fuel-burning appliance 12 may result.

Accordingly, with the described design, the external portion 42 of the vent system 10 can be placed in close proximity to the subjacent ground at the sidewall 18 and may, at this lower height, still be capable of drawing in adequate volumes of clean makeup air without substantial fear of flame-out of the burner or sooting commonly encountered with significant intake losses. This facilitates installation by allowing installers to work at comfortable heights. Fewer installation problems and errors may result. This also places the external portion 42 of the vent system 10 below normal sight lines.

For purposes of integrity, and resistance to corrosion, the components of the wall assembly 36, and particularly those that are exposed to the combustion gases and the elements in the external atmosphere 16, may be made from stainless steel.

An optional third pipe 116, as shown in FIG. 4, may reside between the vent and second pipes 38, 82, respectively, in concentric relationship therewith. Through this arrangement, an annular space 118 is defined between the pipes 38, 82. The space 118 performs an insulating function to minimize heat exchange in the event there are significant temperature differentials between the departing combustion gases and the incoming makeup air from the external atmosphere 16.

It is also contemplated that the vent pipe 38 can be made as a single piece. Prior systems generally use a short stub pipe in the installation process. By using a single pipe construction, the likelihood of a leak into and from the first passage 20 is minimized.

High temperature silicone RTV sealant may be used at critical connections, such as between the downstream end 44 of the vent pipe 38 and the flat plate 48. This minimizes the likelihood of recirculation at this and other locations. The use of a flange 120 on the downstream end 44 of the vent pipe 38 may further facilitate maintenance of the integrity of the connection of the vent pipe 38 and flat plate 48.

The foregoing disclosure of specific embodiments is intended to be illustrative of the broad concepts comprehended by the invention.

The invention claimed is:

1. A direct sidewall vent system between a fuel-burning appliance in a first space and an external atmosphere through a wall between the first space and the external atmosphere, the direct sidewall vent system comprising:

a wall assembly that defines a first passage for communicating combustion gas generated through operation of the fuel-burning appliance to a first outlet through which the combustion gas is communicated to the external atmosphere, the wall assembly defining a second passage for communicating makeup air from the external atmosphere to the fuel-burning appliance in the first space, the second passage having a substantially uniform cross-sectional shape through the wall between the first space and the external atmosphere, the direct sidewall vent system comprising an external portion that is situated within the external atmosphere and at which the first outlet is located, the external portion of the direct sidewall vent system having a top, a bottom, and spaced sides, the external portion of the direct sidewall vent system having a first inlet within the external atmosphere through which makeup air from the external atmosphere is communicated to the second passage, the first inlet situated to draw substantially the entirety of makeup air from the external atmosphere delivered to the fuel-burning appliance through the second passage from a location above the first outlet.

2. The direct sidewall vent system according to claim 1 wherein the wall assembly comprises a vent pipe that has a central axis and defines at least a part of the first passage and the first inlet is situated to draw substantially the entirety of makeup air from the external atmosphere delivered to the fuel-burning appliance through the second passage primarily from a location above the central axis of the vent pipe.

3. The direct sidewall vent system according to claim 1 wherein the second passage has a central axis and the first inlet is situated to draw substantially the entirety of makeup air from the external atmosphere delivered to the fuel-burning appliance through the second passage from a location above the central axis of the second passage.

4. The direct sidewall vent system according to claim 3 wherein the wall assembly comprises substantially concentric cylindrical walls between which at least a part of the second passage is defined.

5. The direct sidewall vent system according to claim 2 wherein the first inlet is situated substantially fully above the central axis of the vent pipe.

6. The direct sidewall vent system according to claim 3 wherein the first inlet is situated substantially fully above the central axis of the second passage.

7. The direct sidewall vent system according to claim 2 wherein the wall assembly comprises a funnel-shaped portion that has a progressively decreasing cross-sectional area from an upstream end of the first passage towards a) a downstream end of the first passage and b) the first outlet, through which combustion gas is jetted to the external atmosphere.

8. The direct sidewall vent system according to claim 7 wherein the wall assembly comprises a shroud that defines the first inlet.

9. The direct sidewall vent system according to claim 7 wherein the first inlet opens downwardly.

10. The direct sidewall vent system according to claim 7 wherein the shroud has a funnel-shaped portion in which incoming makeup air is expanded.

11. The direct sidewall vent system according to claim 9 wherein the wall assembly defines a surface below the first inlet that is inclined upwardly towards the first inlet so as to deflect air directed at the wall between the first space and the external atmosphere towards the first inlet, the surface of the wall assembly coinciding with the central axis of the vent pipe.

12. The direct sidewall vent system according to claim 9 wherein the first outlet opens downwardly.

13. The direct sidewall vent system according to claim 1 further comprising a flow inducing mechanism for at least one of a) inducing flow of combustion gas through the first passage or b) inducing flow of makeup air through the second passage.

14. The direct sidewall vent system according to claim 1 in combination with a fuel-burning appliance within a first space bounded by a wall through which the direct sidewall vent system extends.

15. The direct sidewall vent system according to claim 7 wherein the funnel-shaped portion is oriented to change direction of combustion gas moving in the first passage at the wall and jet combustion gas in a direction angularly downwardly and away from the wall between the first space and external atmosphere.

16. The direct sidewall vent system according to claim 11 wherein the wall assembly comprises metal and the surface of the wall assembly blocks flow of air in an axial direction directly into the first passage.

17. The direct sidewall vent system according to claim 2 wherein the wall assembly comprises a second pipe surrounding the vent pipe and between which at least a part of the second passageway is defined, the second pipe having a top and bottom and makeup air through the first inlet is introduced to the second passage primarily through the bottom of the second pipe.

18. A direct sidewall vent system between a fuel-burning appliance in a first space and an external atmosphere through a wall between the first space and the external atmosphere, the direct sidewall vent system comprising:

a wall assembly that defines a first passage with a central axis for communicating combustion gas generated through operation of the fuel-burning appliance to a first outlet through which the combustion gas is communicated to the external atmosphere, the wall assembly defining a second passage with a central axis that is substantially coincident with the central axis of the first passage for communicating makeup air from the external atmosphere to the fuel-burning appliance in the first space, the direct sidewall vent system comprising an external portion that is situated within the external atmosphere and at which the first outlet is located, the external portion of the direct sidewall vent system having a top, a bottom, and spaced sides, the external portion of the direct sidewall vent system having a first inlet within the external atmosphere through which makeup air from the external atmosphere is communicated to the second passage, the first inlet situated to draw substantially the entirety of makeup air from the external atmosphere delivered to the fuel-burning appliance through the second passage from a location at the top of the external portion of the direct sidewall vent system.

19. A method of venting a fuel-burning appliance in a first space through a vertical sidewall between the first space and an external atmosphere, the method comprising the steps of:

providing a vent system comprising a wall assembly that defines first and second substantially concentric passages with one of the first and second passages having a central axis that extends through the vertical sidewall;

operating the fuel-burning appliance and thereby producing combustion gas;

causing the combustion gas to be directed through the first passage and discharge through a first outlet to the external atmosphere; and causing substantially the entirety of makeup air delivered to the fuel-burning appliance through the second passage to be directed from the external atmosphere through an inlet that is in communication with the second passage and from the inlet downwardly at a location within the inlet towards the central axis of the one of the first and second passages for delivery through the second passage to the fuel-burning appliance.

20. A method of venting a fuel-burning appliance in a first space through a vertical sidewall between the first space and an external atmosphere, the method comprising the steps of:

providing a vent system comprising a wall assembly that defines first and second substantially concentric passages having a central axis that extends through the vertical sidewall and that has an external portion exposed to the external atmosphere and having a top, bottom, and spaced sides;

causing the combustion gas to be directed through the first passage and discharge through a first outlet to the external atmosphere; and causing substantially the entirety of makeup air delivered to the fuel-burning appliance through the second passage to be directed from the external atmosphere through an inlet at the top of the external portion of the vent system for communicating through the second passage to the fuel-burning appliance.

21. The method of venting a fuel-burning appliance according to claim 19 wherein the first inlet resides entirely above the central axis of the one of the first and second passages.

* * * * *